United States Patent [19]

Alembik

[11] 4,292,697

[45] Oct. 6, 1981

[54] FURNITURE FOR SITTING AND RECLINING

[76] Inventor: Alfred Alembik, Anastasius-Grüngasse 37/9, Vienna, 18, Austria

[21] Appl. No.: 89,786

[22] Filed: Oct. 31, 1979

[30] Foreign Application Priority Data

Nov. 2, 1978 [AT] Austria ..... 7845/78

[51] Int. Cl.[3] ..... A47C 17/13

[52] U.S. Cl. ..... 5/18 R; 5/17; 5/23; 297/105; 297/111

[58] Field of Search ..... 5/12, 13, 17, 18, 28, 5/37, 42, 44 R, 47, 19, 20, 23, 18 R; 297/105, 108, 109, 111

[56] References Cited

U.S. PATENT DOCUMENTS

| | | | |
|---|---|---|---|
| 1,821,126 | 9/1931 | Thomas | 5/23 X |
| 3,813,710 | 6/1974 | Janko | 297/105 X |
| 3,867,302 | 2/1975 | Wright | 5/17 |
| 3,974,529 | 8/1976 | Johnson et al. | 5/18 R |
| 4,204,287 | 5/1980 | Lane et al. | 5/18 R |

FOREIGN PATENT DOCUMENTS

| | | | |
|---|---|---|---|
| 328125 | 3/1976 | Austria . | |
| 690790 | 4/1940 | Fed. Rep. of Germany | 5/18 R |
| 1121290 | 1/1962 | Fed. Rep. of Germany | 5/18 R |
| 2423859 | 1/1975 | Fed. Rep. of Germany | 5/23 |

*Primary Examiner*—James T. McCall

*Attorney, Agent, or Firm*—Martin A. Farber

[57] ABSTRACT

Furniture for sitting and reclining with which on a carriage which is movable from the frame, in the seat position two cushions are laid down one above the other and in the reclining position they are placed one behind the other. A back cushion preferably is fixedly connected with the frame. A wedge cushion is displaceably and swingably guided on the frame from a maintaining position in the seating position behind the back cushion into a use position in the reclining position in connection with the two cushions which are laid one behind the other on the carriage. By a suspension the upper edge of the wedge cushion preferably is connected swingably with the back cushion and the lower edge is swingably connected with an inner part of the carriage, the inner part being formed as a bedding box.

11 Claims, 8 Drawing Figures

FURNITURE FOR SITTING AND RECLINING

Figure 2:
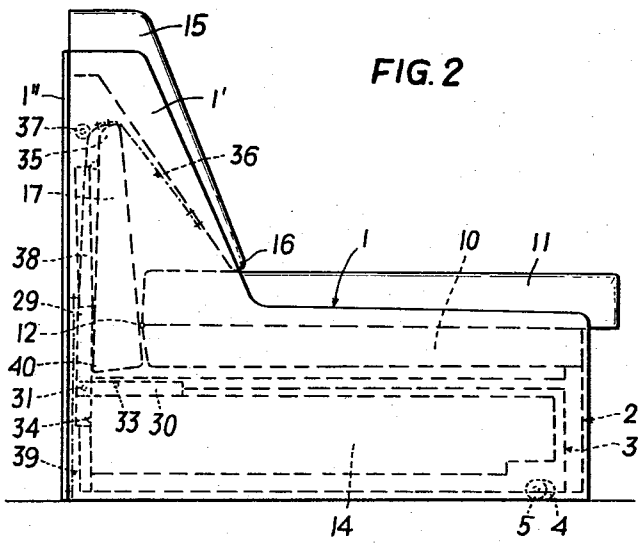

The invention relates to furniture for sitting and reclining, with which on a carriage which is movable from the frame, in the seat position two cushions are laid down one above the other and in the reclining position they are placed one behind the other, whereby a back cushion preferably is rigidly connected with the frame and a wedge cushion is provided, which wedge cushion is displaceably and swingably guided on the frame from a maintaining position in the seat position behind the back cushion into a use position in the reclining position in connection with the two cushions which are laid one behind the other on the carriage, according to Austrian Pat. No. 328 125.

The wedge cushion with the known furniture with its edge which in the maintenance position is the upper edge is guided with the use of rollers or slides on guides which are formed from grooves or rails, which rails or grooves are provided in, or respectively, on the frame, whereas to the contrary its edge which in the maintenance position is the bottom rear edge is connected articulatedly with the carriage.

The arrangement of guides formed of rails or grooves presumes a corresponding formation of the frame of the furniture and thus makes its construction costly and expensive.

The invention sets thus the task to form furniture for sitting and reclining of the introductory-mentioned type such that with a constructively simple construction, particularly by avoiding guides and fittings, which in the long run provide cause for disturbances, an automatic conversion from the seat position into the reclining position and back again from the reclining position into the seat position is made possible.

The object is solved in accordance with the present invention in the manner that by means of a suspension or attachment the upper edge of the wedge cushion preferably is connected swingably with the back cushion and the lower edge is swingably connected with an inner part of the carriage, which inner part is formed as a bedding box.

With the conversion of the furniture from the reclining position into the seat position the suspension acts as a swinging aid for the wedge cushion, so that without any guiding the latter can be brought, in the seat position, behind the back cushion into a supply or maintenance position.

According to one embodiment of the invention the suspension comprises a flexible or bendable material, under certain circumstances a rubber-elastic material, for instance textile material. The suspension which in the framework of the invention comprises a textile material extends over the entire width of the wedge cushion and is attached to the rear side of the back cushion.

Particularly with a suspension formed of a rubber-elastic material, which suspension supports per se the return movement of the wedge cushion into the maintenance position, feet or legs are articulated on the wedge cushion, by means of a preferably rubber-elastic tension member or tie rod, which feet, in the seat position are swingable on or to, the wedge cushion, and respectively, in the reclining position are swingable into a perpendicular position relative to the wedge cushion. By such type of legs a particularly stable support of the wedge cushion is achieved in the reclining position. Another type of securing or holding of the wedge cushion in the reclining position in accordance with the invention resides in that the wedge cushion is connected to the bedding box by means of a joint made of flat bands, the joint being laterally abutable, whereby the one band has an extension which projects beyond the pivot point, for which on the other band an abutment or detent is arranged.

Figure 1:
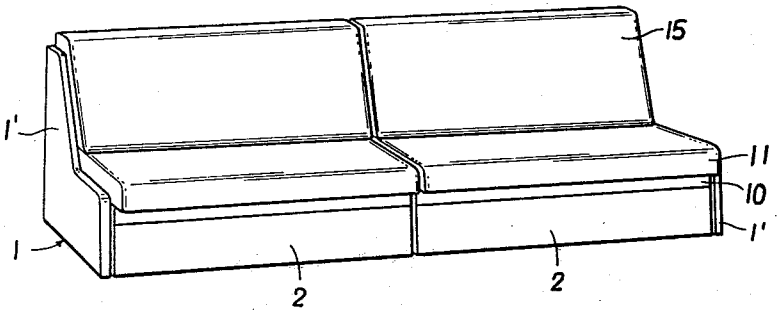
Figure 3:
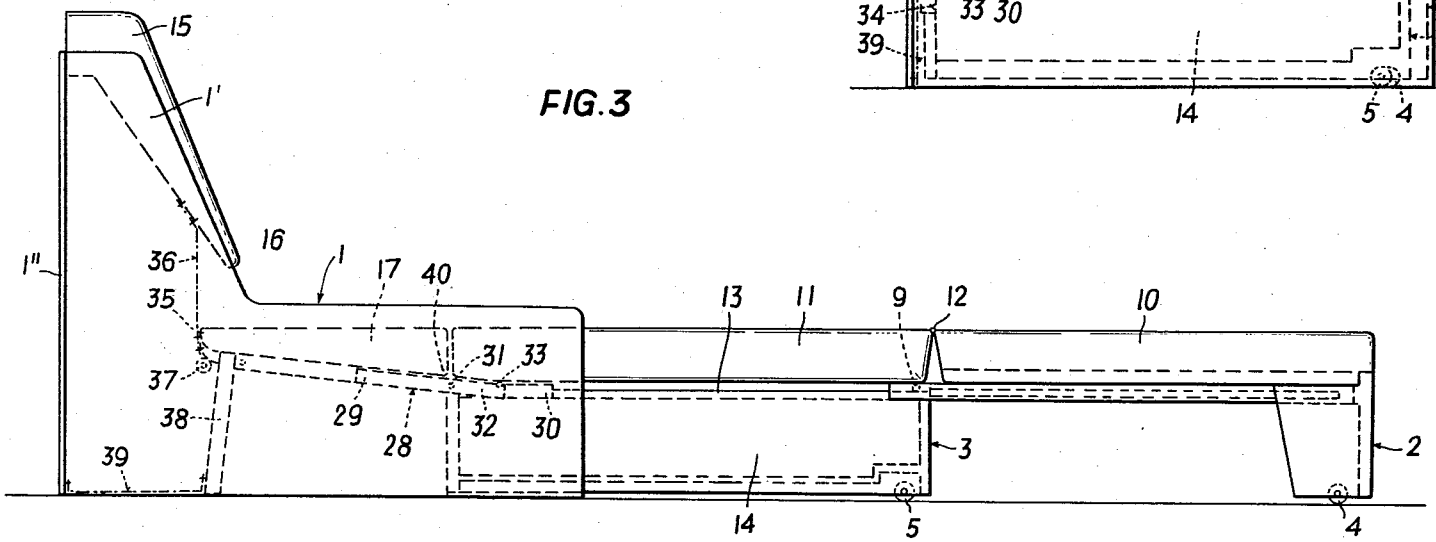
Figure 4:
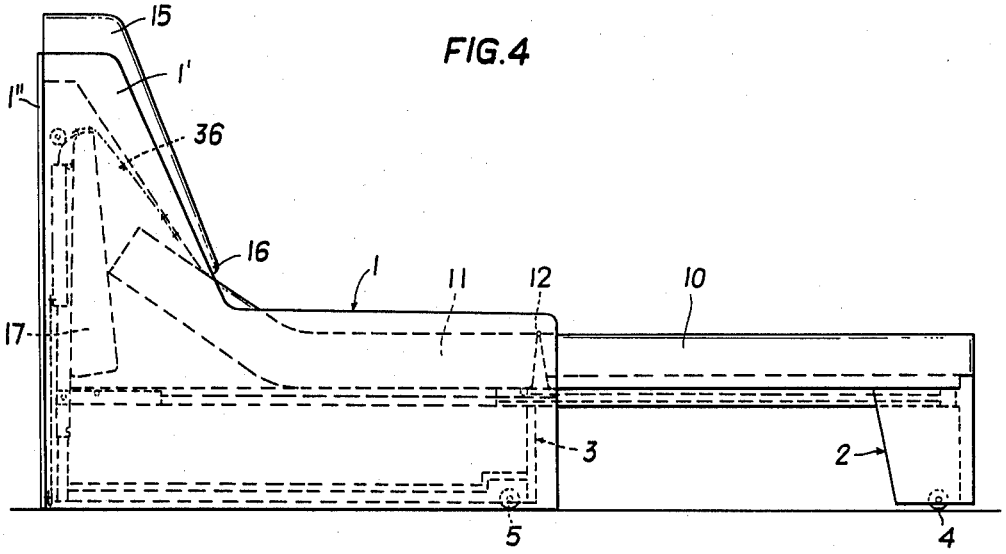
Figure 5:
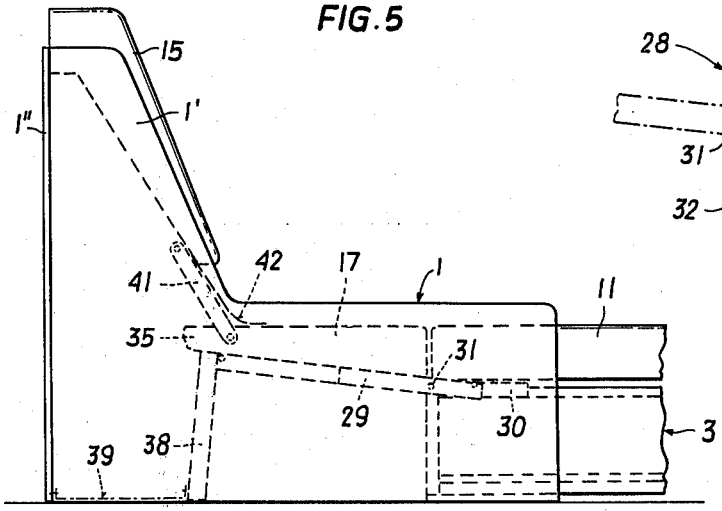
Figure 6:
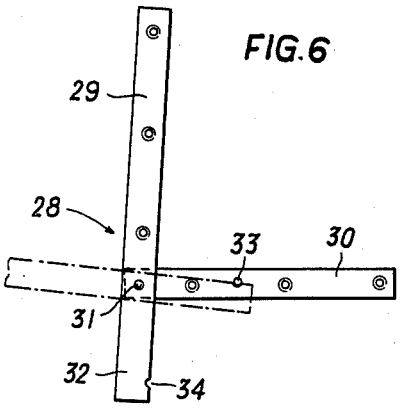
Figure 8:
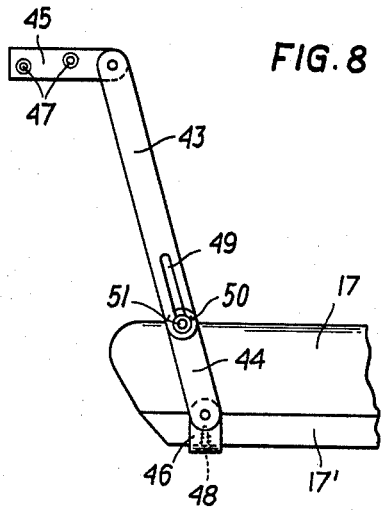
Figure 7:
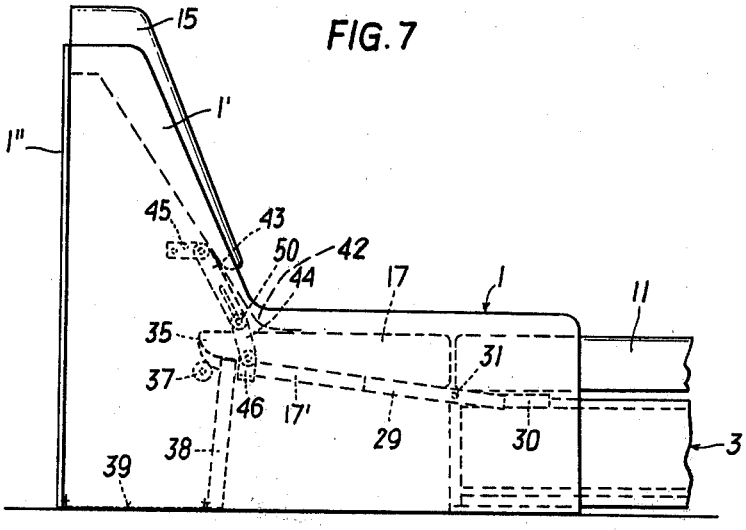

Details of the invention are more closely explained on the basis of the drawing which illustrates embodiment forms by way of example of the seat and reclining furniture. They show:

FIG. 1 a perspective view of the furniture in accordance with the invention in the seat position, FIG. 2 a side view of the furniture in the seat position, FIG. 3 a side view of the furniture in the reclining position partially in section, FIG. 4 a side view of the furniture in rest position, FIG. 5 a detail of a modified embodiment form of the suspension of the wedge cushion, FIG. 6 a detail in enlarged illustration, FIG. 7 illustrates a side view of a further embodiment of a suspension with the wide wall removed, and FIG. 8 represents an enlarged illustration of the suspension according to FIG. 7 in side view.

The seat and reclining furniture in accordance with the invention has a framework 1 which is made of the side walls 1' and a rear wall 1''. Armrests are constructionally not necessary with the furniture in accordance with the invention, however can be provided naturally. A carriage which comprises an outer part 2 and an inner part 3 is able to be moved out from the frame 1. The two parts of the carriage are supported thereby by means of rollers 4 and 5 or slides or gliders with respect to the floor. The inner part 3 of the carriage is formed as a bedding box or drawer 14 which is closeable by means of a cover 13, which cover is provided with a wire insert or formed from a plate. For this purpose, or in this configuration the cover 13 is articulated on the bedding box 14 swingable about a hinge. The outer part 2 of the carriage is supported with rollers or slides 9 upon the inner part 3 of the carriage, and respectively, on the cover 13. A cushion or upholstery 10 is fixedly arranged on the outer part 2 of the carriage, on which cushion 10 a cushion 11 is articulatedly connected by means of a material hinge or the like 12, which cushion 11 in the seat position is laid down upon the cushion 10 and in the reclining position can be laid down on the cover 13.

A back cushion or upholstery 15 preferably fixedly connected with the frame 1 of the seat and reclining furniture, the lower edge 16 of which cushion can be formed elastically and consequently in the seat position, rests on the upper cushion 11. Behind the back cushion and the rear wall 1'' a space is left free in which in the seat position a wedge cushion 17 can be accommodated. This wedge cushion 17 with its forward lower edge 40 is connected with the inner part 3 of the carriage, or respectively, with the bedding box 14, by means of a hinge 28, which hinge is made of flat bands, whereby one band 29 is fastened onto the wedge pillow, whereas the band 30 is fastened onto the inner part 3 of the carriage, or respectively, onto the bedding box 14. For this purpose the band 29 has an extension 32 projecting over the pivot point 31, and an abutment 33 is provided on the band 30, which abutment abuts against the extension 32 in the reclining position and consequently secures the wedge cushion 17 in the position of use. For this purpose in the extension 32 a recess 34 for this abutment can be provided, so that the hinge can be brought into its stretched position.

The upper edge 35 of the wedge cushion or pillow 17 is preferably connected pivotally swingably with the back cushion 15 by means of a bendable or flexible, if necessary or appropriate, rubber-elastic, suspension 36. Upon conversion of the furniture from the reclining position into the seat position consequently the wedge pillow 17 with its upper edge 35 is swung upwardly and, in the space which is left free between the back cushion 15 and the rear wall 1'', is brought into a supply or maintenance position. The upper edge 35 of the wedge cushion 17 for this purpose can be provided with rollers or slides 37, which facilitate or make easier the bringing of the wedge cushion behind the back cushion 15 by guidance along the rear wall 1''. The wedge cushion 17 moreover can be provided with feet 38 which are connected pivotally with the bottom side of the wedge cushion 17 and by means of a rubber-elastic tension member or tie rod 39 are connected on the inner side with the rear, lower edge of the frame 1. By means of the tie rod 39, upon conversion of the furniture from the sitting position to the lying position the feet 38 are brought into the position illustrated in FIG. 3, whereas the tie rod 39 during the re-conversion of the furniture causes a tilting or folding in of the feet 38 against or towards the lower side of the wedge cushion 17.

In FIG. 4 it is illustrated that by pushing in or inserting the carriage solely with its inner part 3, a rest position can be achieved in which the cushion 11 is partially raised or put upright along the wedge cushion 17, so that a sitting position with legs outstretched on the furniture is possible.

According to the embodiment illustrated in FIG. 5 the wedge cushion 17 is suspended by means of connecting rods or guides 41, which on the one side are articulatedly connected with the upper edge 35 of the wedge cushion 17, and on the other side are articulatedly connected with the rear side of the back cushion 15. These connecting rod guides 41, in the same manner as the suspension 36 (which suspension is made, under circumstances if necessary, of elastic material), upon pushing in or inserting the carriage 2, 3 from the reclining position to the sitting position cause a horizontal swinging of the wedge cushion 17 from the use position into the maintenance position and vice versa, during a conversion of the furniture from the seating position into the reclining position, a horizontal swinging from the maintenance position into the use position.

In the reclining position of the furniture the gap which develops between the back cushion 15 and the wedge cushion 17, can be covered by a covering 42 made of upholstery fabric, which on the one hand is connected with the back side of the back cushion 15 and on the other hand is connected with the upper side of the wedge cushion 17. Another embodiment of the suspension and, respectively, articulation of the wedge cushion 17 is set forth in FIGS. 7 and 8. In this embodiment respectively each connecting rod pair 43, 44 is provided whereby the connecting rods 43 are articulated on the side walls 1' of the furniture by means of metal or hardware mountings 45, whereas the connecting rods 44 are articulatedly connected with a frame 17' of the wedge cushion 17 by means of hardware mountings 46. The fastening of the mountings 45 to the side wall 1' is brought about with the use of screws 47 and the fastening of the mountings 46 to the frame 17' is brought about with screws 48. A longitudinal slot 48 is arranged in each of the connecting rods 43 into which slot there engages a laterally projecting pivot joint bolt 51, which pivot joint bolt is arranged on the joint 50 between the two connecting rods 43 and 44. In the reclining position of the furniture the pivot bolt 51 lies at the lower end of the longitudinal slot and therewith secures the position of the wedge cushion 17. With the displacement of the carriage 2, 3 from the reclining position into the seating position the upper edge 35 of the wedge cushion 17 is moved inwardly and simultaneously is lifted until the rollers 37 or slides come into contact with the rear wall 1'' of the furniture and roll or respectively slide up along the latter. The longitudinal slot 49 for this purpose makes possible a folding together of the connecting rod pair 43, 44 and a swinging up of the wedge cushion 17 into its maintenance position behind the back cushion 15. The conversion from the seating position of the furniture into its rest position proceeds in the reverse sequence.

The illustrated and described embodiment forms serve only for an explanation of the essence of the invention, without limitation thereof to particulars. The cushions can thus be formed in one piece or can comprise two or three parts. Also the seat and reclining furniture can be constructed as an armchair.

I claim:

1. In furniture for sitting and reclining with which on a carriage which is movable from the frame, in the seat position two cushions are laid down one above the other and in the reclining position they are placed one behind the other, with a back cushion rigidly connected with the frame and a wedge cushion being provided, which wedge cushion is displaceably and swingably guided on the frame from a maintaining position in the seating position behind the back cushion into a use position in the reclining position in connection with the two cushions which are laid one behind the other on the carriage, the improvement comprising suspension means for connecting an upper edge of the wedge cushion swingably with the back cushion, a lower edge of the back cushion is swingably connected with an inner part of the carriage, said inner part being formed as a bedding box, in the reclining position of the furniture said back cushion and said wedge cushion define a gap therebetween, a covering connected to said wedge cushion and said back cushion covers said gap, said covering is made of upholstery fabric, a wedge cushion frame in which said wedge cushion is mounted, said suspension means comprises pairs of connecting rods, one of said connecting rods of each said pair is swingably fastened to said frame, and the other of said connecting rods is swingably fastened to said wedge cushion frame, said one connecting rod is formed with a longitudinal slot, a joint is disposed between said connecting rods and has a pivot bolt laterally projecting between said connecting rods engaging in said longitudinal slot.

2. The furniture as set forth in claim 1, wherein said frame has a rear interior wall, at least portions of said back cushion are spaced from said rear interior wall, means for operatively guiding the upper edge of the wedge cushion along the rear interior wall of the frame during a conversion of the furniture from one position into the other position.

3. The furniture as set forth in claim 2, wherein said guiding means are rollers arranged on the upper edge of the wedge cushion and rollable along the rear interior wall.

4. The furniture as set forth in claim 2, wherein said guiding means are slides arranged on the upper edge of the wedge cushion and slidable along the rear interior wall.

5. The furniture in accordance with claim 1, wherein said covering means comprises a textile material which extends over the entire width of the wedge cushion and is attached to a rear side of the back cushion.

6. The furniture according to claim 1, further comprising legs are articulated to the wedge cushion, said legs in the seat position are swingable up against the wedge cushion, and respectively, in the reclining position are swingable into a perpendicular position relative to the wedge cushion.

7. The furniture as set forth in claim 6, further including tie rod means connected to said legs for effecting the swinging movement of said legs.

8. The furniture as set forth in claim 7, wherein said tie rod means is rubber-elastic.

9. The furniture according to claim 1, further comprising a hinge means for articulation of the wedge cushion to the bedding box is made of flat bands pivoted at a pivot point, said hinge means is laterally stoppable, one of said bands has an extension projecting beyond said pivot point, an abutment on the other band cooperatively engages said extension in a relative pivoted position of said bands so as to fix the reclining position of the wedge cushion.

10. In furniture for sitting and reclining with which on a carriage which is movable from the frame, in the seat position two cushions are laid down one above the other and in the reclining position they are placed one behind the other, with a back cushion preferably being rigidly connected with the frame and a wedge cushion being provided, which wedge cushion is displaceably and swingably guided on the frame from a maintaining position in the seating position behind the back cushion into a use position in the reclining position in connection with the two cushions which are laid one behind the other on the carriage, the improvement comprising suspension means for connecting an upper edge of the wedge cushion swingably with the back cushion, a lower edge of the back cushion is swingably connected with an inner part of the carriage, said inner part being formed as a bedding box, a wedge cushion frame in which said wedge cushion is mounted, said suspension means comprises pairs of connecting rods, one of said connecting rods of each said pair is swingably fastened to said frame, and the other of said connecting rods is swingably fastened to said wedge cushion frame, said one connecting rod is formed with a longitudinal slot, a joint is disposed between said connecting rods and has a pivot bolt laterally projecting between said connecting rods engaging in said longitudinal slot.

11. The furniture as set forth in claim 10, further comprising first fittings connect said one connecting rod to side walls of the frame and second fittings connect said other connecting rod to said wedge cushion frame.

* * * * *